US012612834B2

(12) United States Patent
Witte et al.

(10) Patent No.: US 12,612,834 B2
(45) Date of Patent: Apr. 28, 2026

(54) DOWNHOLE ORIENTING HELIX FOR OPERATIONS REQUIRING MULTIPLE ORIENTING SEQUENCES

(71) Applicant: Halliburton Energy Services, Inc., Houston, TX (US)

(72) Inventors: Jason P. Witte, Carrollton, TX (US); David J. Steele, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 95 days.

(21) Appl. No.: 18/524,134

(22) Filed: Nov. 30, 2023

(65) Prior Publication Data

US 2025/0179890 A1 Jun. 5, 2025

(51) Int. Cl.

| | |
|---|---|
| ***E21B 23/14*** | (2006.01) |
| ***E21B 17/02*** | (2006.01) |
| ***E21B 17/10*** | (2006.01) |
| ***E21B 17/22*** | (2006.01) |
| ***E21B 23/02*** | (2006.01) |

(52) U.S. Cl.
CPC ..... *E21B 23/14* (2013.01); *E21B 17/023* (2013.01); *E21B 17/10* (2013.01); *E21B 17/22* (2013.01); *E21B 23/02* (2013.01)

(58) Field of Classification Search
CPC ..... E21B 17/023; E21B 17/10; E21B 17/22; E21B 23/02; E21B 23/14
See application file for complete search history.

(56) References Cited

U.S. PATENT DOCUMENTS

| | | | |
|---|---|---|---|
| 5,129,453 | A | 7/1992 | Greenlee |
| 5,566,763 | A | 10/1996 | Williamson et al. |
| 6,019,173 | A | 2/2000 | Saurer et al. |
| 9,140,081 | B2 | 9/2015 | Telfer et al. |
| 2003/0085815 | A1 | 5/2003 | Tilton et al. |

(Continued)

FOREIGN PATENT DOCUMENTS

WO WO-2017160278 A1 * 9/2017 ..... E21B 34/14

OTHER PUBLICATIONS

International Search Report and Written Opinion for International Patent Application No. PCT/US2023/086249 dated Aug. 27, 2024. PDF file. 10 pages.

(Continued)

*Primary Examiner* — Nicole Coy
*Assistant Examiner* — Nicholas D Wlodarski
(74) *Attorney, Agent, or Firm* — Scott Richardson; C. Tumey Law Group PLLC

(57) ABSTRACT

A slotted sub apparatus may include a tubular body portion and a main guide feature extending axially along the tubular body portion. The main guide feature is configured to receive a key of an orienting sub, and an interface between the key and sidewalls of the main guide feature is configured to guide rotation of the orienting sub as the orienting sub moves axially with respect to the tubular body portion. The slotted sub apparatus may further include at least one pullout guide feature configured to receive the key of the orienting sub as the orienting sub moves in an axially uphole direction with respect to the tubular body portion. The at least one pullout feature is configured to guide rotation of the orienting sub as the key moves along the at least one pullout guide feature.

19 Claims, 8 Drawing Sheets

(56) References Cited

U.S. PATENT DOCUMENTS

| | | | | |
|---|---|---|---|---|
| 2015/0259990 | A1* | 9/2015 | June | E21B 33/038 166/341 |
| 2015/0259999 | A1* | 9/2015 | Gonzalez | E21B 23/02 166/385 |
| 2017/0211346 | A1 | 7/2017 | Bullock | |
| 2018/0187519 | A1 | 7/2018 | Rodriguez et al. | |
| 2018/0340377 | A1* | 11/2018 | Eggers | E21B 17/046 |
| 2021/0172266 | A1 | 6/2021 | Dietz et al. | |
| 2023/0145176 | A1* | 5/2023 | Dietz | E21B 23/03 166/381 |
| 2023/0272684 | A1* | 8/2023 | Saponja | E21B 23/01 166/206 |

OTHER PUBLICATIONS

U.S. Appl. No. 17/523,469 dated Nov. 10, 2021.
U.S. Appl. No. 17/523,533 dated Nov. 10, 2021.

* cited by examiner

DOWNHOLE ORIENTING HELIX FOR OPERATIONS REQUIRING MULTIPLE ORIENTING SEQUENCES

BACKGROUND

After drilling a wellbore in a subterranean formation for recovering hydrocarbons such as oil and gas lying beneath the surface, completion tools may be run into the wellbore. Generally, these completion tools are configured to protect the wellbore from failure and provide a fluid path for hydrocarbons during production. These completion tools may include valves and/or other actuatable mechanisms for controlling flow of the production fluid. As such, a control line may be run from the surface to the downhole tools during completion operations to provide communication between these mechanisms and the surface. Generally, the control line may be run-in-hole via an orienting sub that interfaces with a slotted sub to align the control line with a corresponding connection.

However, during the connection process, operators may need to pickup the orienting sub in response to a failed connection between the control line and the corresponding connection. The interface between the slotted sub and the orienting sub may rotate the orienting sub in a first direction each time the orienting sub is picked up and in an opposite direction each time the orienting sub is re-inserted into the slotted sub. Unfortunately, the amount of rotation in the first direction may be different than the amount of rotation in the opposite direction. Having uneven amounts of rotation may not be favorable for the work string connected to the orienting sub or for the control line. That is, having uneven amounts of rotation may unthread the work string and/or tangle the control line.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for controlling rotation of an orienting sub moving axially uphole through a slotted sub and, more particularly, example embodiments may include a slotted sub having at least one pullout guide feature configured to receive at least one key of the orienting sub as the orienting sub moves in an axially uphole direction along a helical portion of the slotted sub. The helical portion may be configured to drive rotation of the orienting sub as the orienting sub moves in the axially uphole direction. Further, as the orienting sub moves in the axially uphole direction, the orienting sub may exit the helical portion at the least one pullout guide feature. With respect to the helical portion, the at least one pullout guide feature may reduce or eliminate rotation of the orienting sub to control rotation of the orienting sub Controlling rotation of the orienting sub during pullout may maintain even rotation between pullout and reinsertion of the orienting sub to reduce unthreading for the work string and/or tangling of the control line while connecting the control line to the corresponding connection.

Figure 1:
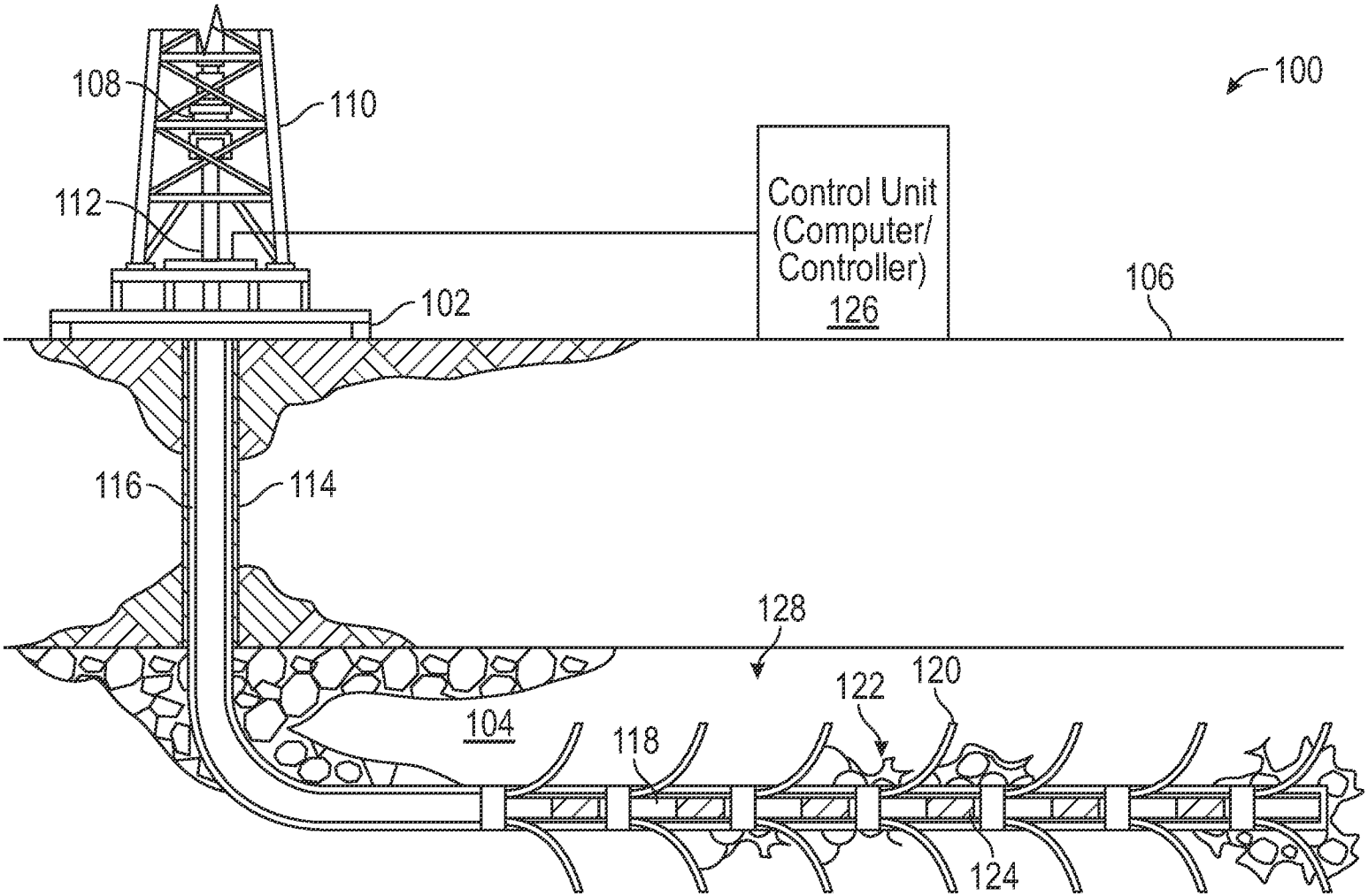
FIG. 1 illustrates an elevation view of a well system, in accordance with some embodiments of the present disclosure.

FIG. 1 illustrates an elevation view of a well system, in accordance with some embodiments of the present disclosure. The well system 100 includes a platform 102 positioned over a subterranean formation 104 located below the earth's surface 106. The platform 102 may include a hoisting apparatus 108 and a derrick 110 for raising and lowering a downhole conveyance 112, such as a drill string, casing string, tubing string, coiled tubing, a running tool, etc. Although a land-based oil and gas platform 102 is illustrated in FIG. 1, the scope of this disclosure is not thereby limited, and thus could potentially apply to offshore applications.

As illustrated, the well system 100 may include a main wellbore 114. A first tubing 116 and a second tubing 118, having differing tubular diameters, may be run into the main wellbore. Further, the well system 100 may include one or more lateral wellbores 120 branching out from the main wellbore 114. For well systems 100 having lateral wellbores 120, a lower completion 128 of the well system 100 may include a plurality of multilateral junctions 122 positioned at junctions between the main wellbore 114 and the lateral wellbores 120. Moreover, the lower completion 128 may include a slotted sub apparatus and/or keyed running tool (e.g., orienting sub). Thus, for well systems 100 having lateral wellbores 120, the multilateral junction 122 may include the slotted sub apparatus configured to receive the keyed running tool during completion operations. Alternatively, another portion of the lower completion 128 may include the slotted sub apparatus and/or keyed running tool.

The well system 100 may additionally include one or more interval control valves 124 ("ICVs") positioned at various locations within the main wellbore 114 and/or one or more of the lateral wellbores 120. The well system 100 may additionally include a surface control unit 126. The surface control unit 126 may be configured to output signals to control one or more downhole devices. Additionally, the surface control unit 126 may be configured to receive signals from the one or more downhole devices.

Figure 2:
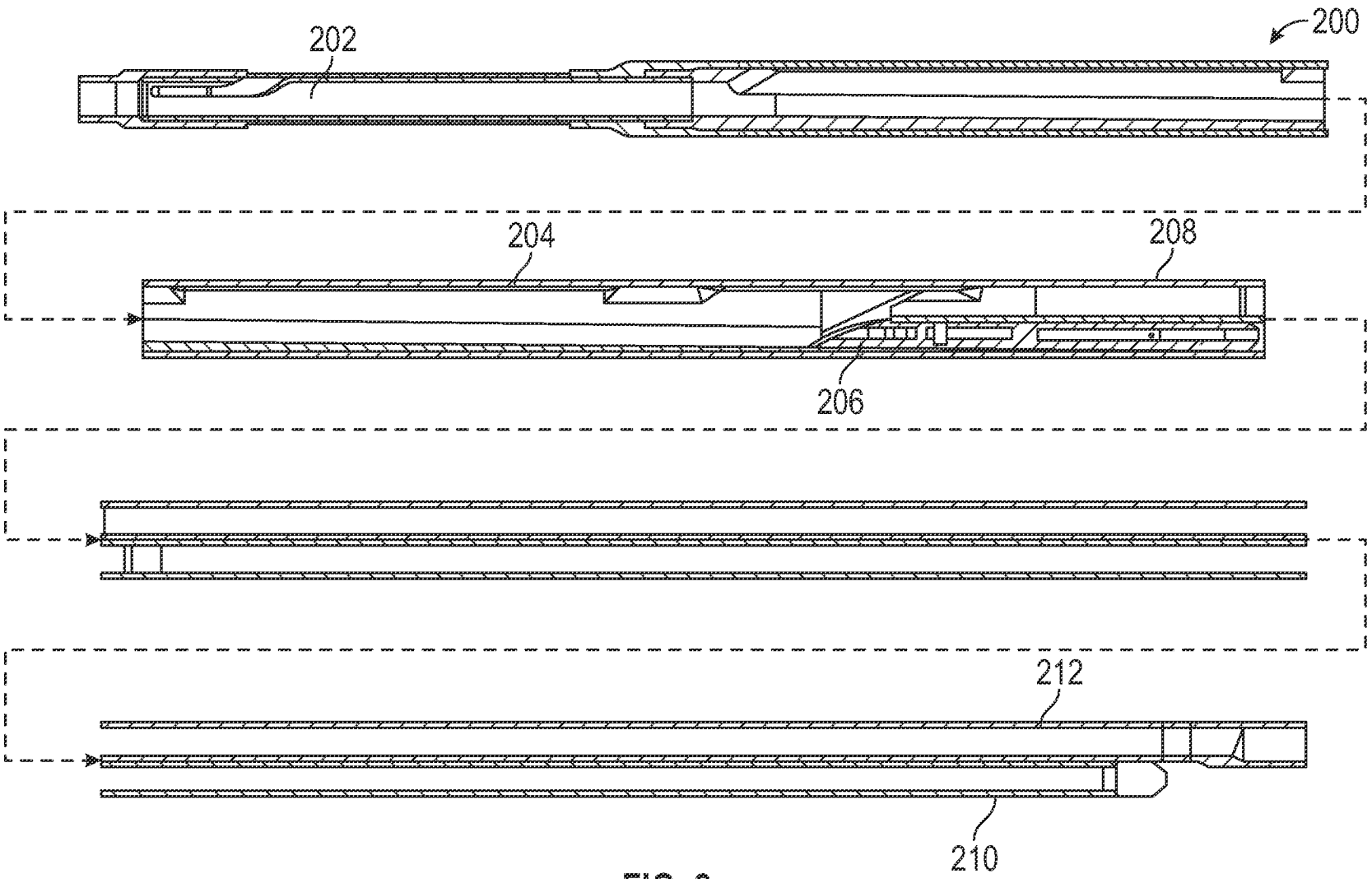
FIG. 2 illustrates a cross-sectional view of a multilateral junction of the well system, in accordance with some embodiments of the present disclosure.

FIG. 2 illustrates a cross-sectional view of a multilateral junction of the well system, in accordance with some embodiments of the present disclosure. As illustrated, the multilateral junction 200 may include a slotted sub apparatus 202. As set forth in greater detail below, the slotted sub apparatus 202 may include a tubular body portion having a main guide feature (e.g., a slot or groove) extending at least partially through the tubular (shown in FIG. 3). Further, as illustrated, the multilateral junction 200 may additionally include a tubular spacer 204 positioned downhole of the slotted sub apparatus 202, a whipstock 206 positioned downhole of the tubular spacer 204, and a y-block 208 positioned downhole of the whipstock 206. The multilateral junction 200 may additionally include a main bore leg 210 and a lateral bore leg 212 coupled to a downhole end of the y-block.

Moreover, a keyed running tool (e.g., orienting sub) may be used to position (e.g., rotationally position) one or more features within the multilateral junction 200. Alternatively, the keyed running tool may be used to rotationally position one or more features within a single well. Further, the orienting sub, in combination with the slotted sub apparatus 202, may be configured to align a control line secured to the orienting sub with a corresponding connector of a downhole completion tool. Alternatively, or additionally, the orienting sub may be configured to position the whipstock 206 (e.g., a tubing exit whipstock) at a desired lateral and rotational position within the multilateral junction 200. Further, the slotted sub apparatus 202 may be used to position different features within the multilateral junction 200, or alternatively could be used to position different features not associated with the multilateral junction 200.

Further, the apparatuses, features, systems and methods disclosed within may be applied to other types of remote operations where the tools, operations, processes are separated from the operators by distances, barriers, adverse environments, etc. The ability to remotely perform operations requiring multiple orienting sequences makes the invention suitable for use in other remote locations with harsh environments such as outer space (e.g., satellites, spacecrafts, etc.), aeronautics (aircrafts, drones), on-ground (swamps, marshes, power generation, hydrogen or other gas extraction and/or transportation, etc.), below ground (mines, caves, etc.), ocean (on surface and subsea), subterranean (mineral extraction, storage wells (carbon sequestration, carbon capture and storage (CCS), etc.)), and other energy recovery activities (geothermal, steam, etc.). The unhabitable environments may comprise corrosive fluids (hydrocarbons, H2S fluids, C02 fluids, acids, bases, gases, etc.), contaminants (sand, debris, paraffins, asphaltenes, etc.), high-temperature fluids (fluids from geothermal formations, injected fluids, etc.), cryogenic fluids, etc. Example implementations may be utilized in harsh conditions (e.g., corrosive environments or contaminated fluids), extreme pressures (e.g., >5,000-psi differential), extreme temperatures (e.g., <−20° F. and/or >300° F.).

Figure 3:
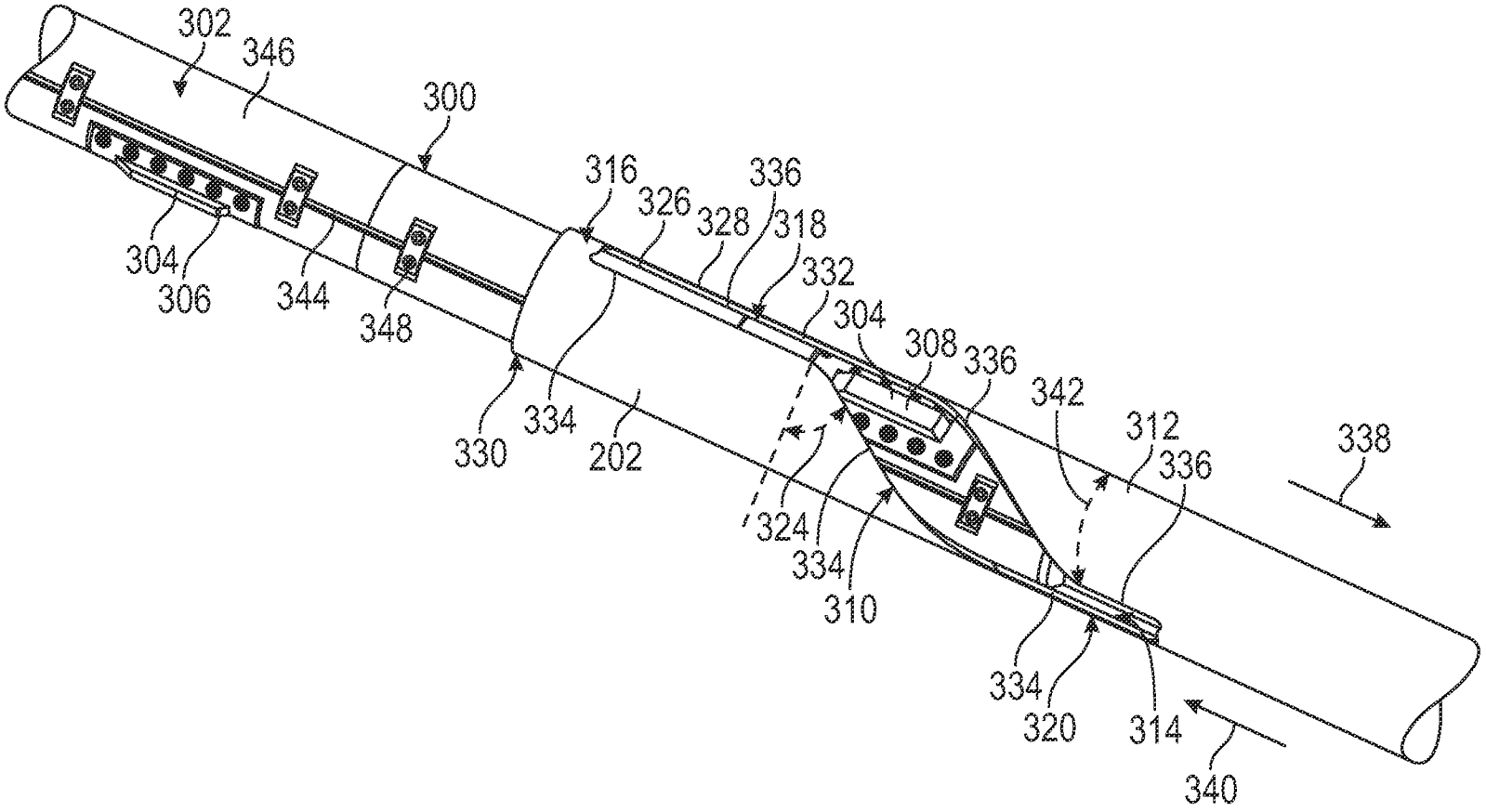
FIG. 3 illustrates a perspective view of a slotted sub apparatus receiving an orienting sub, in accordance with some embodiments of the present disclosure.

FIG. 3 illustrates a perspective view of a slotted sub apparatus receiving an orienting sub, in accordance with some embodiments of the present disclosure. An orienting sub 300 is securable to a downhole end of the conveyance 112 (shown in FIG. 1) and configured to be run into a wellbore (e.g., the main wellbore 114 and/or lateral wellbores 120) via the conveyance 112. The orienting sub 300 includes a body portion 302 and at least one key 304 extending radially outward from the body portion 302. As illustrated, the at least one key 304 may include two keys (e.g., a first key 306 and a second key 308). However, the at least one key 304 of the orienting sub 300 may include any suitable number of keys 304. For example, the at least one key 304 may include three keys or more. Alternatively, the at least one key 304 may include only a single key. The at least one key 304 is configured to interface with at least a main guide feature 310 of the slotted sub apparatus 202 to guide movement of the orienting sub 300 as the orienting sub 300 moves through the slotted sub apparatus 202.

The slotted sub apparatus 202 includes a tubular body portion 312 having a central bore 314 configured to receive the orienting sub 300. Further, the slotted sub apparatus 202 includes the main guide feature 310 that generally extends along the length of the tubular body portion 312 in the axial direction. As set forth above, the main guide feature 310 is configured to guide movement of the orienting sub 300 as the orienting sub 300 moves through the slotted sub apparatus 202. That is, the orienting sub 300 may move axially without rotating as the at least one key 304 of the of the orienting sub 300 moves along axial portions (e.g., an upper entry portion 316, an upper axial portion 318, a lower axial portion 320, etc.) of the main guide feature 310. However, as illustrated, the main guide feature 310 may also include at least one helical portion 322 that paths at least partially in a circumferential direction about the tubular body portion 312. The helical portion 322 of the main guide feature 310 may drive the orienting sub 300 to rotate as the at least one key 304 of the orienting sub 300 moves along the helical portion 322. Rotation of the orienting sub 300 may be based at least in part on a length of the helical portion 322 as well as on a helix angle 324 of the helical portion 322. As illustrated, the helical portion 322 may have a helix angle 324 of about forty-five degrees. However, the helical portion 322 may include any suitable helix angle 324. For example, the helical portion 322 may have a helix angle 324 between thirty degrees and sixty degrees. Alternatively, the helix angle 324 may be between five degrees and eighty-five degrees.

Moreover, the main guide feature 310 may extend at least partially through the tubular body portion 312 of the slotted sub apparatus 202 in a radial direction from an inner surface 326 of the tubular body portion 312 toward an outer surface 328 of the tubular body portion 312. That is, the main guide feature 310 may include a slot, a groove, or some combination thereof, formed in the tubular body portion 312. As illustrated, the upper entry portion 316 of the main guide feature 310 may include a groove disposed at an upper end 330 of the slotted sub 202 that is configured to receive the at least one key 304 of the orienting sub 300 as the orienting sub 300 is received into the central bore 314 of the slotted sub 202. Further, the upper axial portion 318 of the main guide feature 310, which is disposed between the upper entry portion 316 and the at least one helical portion 322, may include a slot extending radially through the tubular body portion 312. The at least one helical portion 322 and the lower axial portion 320 may also include slots as illustrated. However, the various portions (e.g., the upper entry portion 316, the upper axial portion 318, the at least one helical portion 322, the lower axial portion 320, etc.) of the main guide feature 310 may include any suitable types of channels (e.g., slots, grooves, etc.), or combinations thereof, for receiving and interfacing with the at least one key 304 of the orienting sub 300.

Further, each portion of the main guide feature 310 may include sidewalls 332 (e.g., an upper sidewall 334 and a lower sidewall 336) configured to interface with the at least one key 304 to guide movement (e.g., rotation) of the orienting sub 300 as the orienting sub 300 moves axially with respect to the tubular body portion 312. The upper sidewall 334 and the lower sidewall 336 may be substantially parallel to one another. Additionally, the sidewalls 332 may be orthogonal with respect to an outer surface of the tubular body portion 312. Alternatively, as set forth below, the upper sidewall 334 and/or the lower sidewall 336 may be offset from orthogonal with respect to the outer surface of the tubular body portion 312. Further, the sidewalls 332 of the main guide feature 310 may be spaced apart sufficiently to permit passage of the at least one key 304 between the respective sidewalls 332. However, the sidewalls 332 may only be spaced apart by a distance slightly larger than the at least one key 304 such that the sidewalls 332 may interface with the at least one key 304 in response to the at least one key 304 deviating from a path of the main guide feature 310.

For example, as the at least one key 304 moves from the upper axial portion 318 to the at least one helical portion 322, the at least one key 304 may contact the lower sidewall 336 at least one helical portion 322. As the orienting sub 300 moves in the axially downhole direction 338 with respect to the slotted sub 202, the at least one key 304 may slide along the lower sidewall 336 such that the at least one key 304 moves along a helical path of the at least one helical portion 322. Such movement of the at least one key 304 may rotate the orienting sub 300. Further, in response to the at least one key 304 entering the lower axial portion 320, the upper sidewall 334 and the lower sidewall 336 may interface with the at least one key 304 to maintain the at least one key 304 along an axial path of the lower axial portion 320, which may prevent the orienting sub 300 from rotating. Additionally, as the orienting sub 300 moves in the axially uphole direction 340 with respect to the slotted sub 202, such that the at least one key 304 moves from the lower axial portion 320 into the helical portion 322, the at least one key 304 may contact the upper sidewall 334 and slide along the upper sidewall 334 such that the at least one key 304 moves along the helical path of the at least one helical portion 322 and rotates the orienting sub 300 accordingly.

Further, the channel (e.g., slot, groove, etc.) of the main guide feature 310 and the at least one key 304 may have complementary features (faces, slots, profiles, shapes, etc.) to enhance the performance of the interface between the channel and the at least one key 304. For example, the lower sidewall 336 of the channel may include an offset angle such that the lower sidewall 336 is not orthogonal with respect to the outer surface of the tubular body portion 312. In particular, the lower sidewall 336 may be offset from orthogonal by a lower offset angle between one and fifteen degrees. Further, the at least one key 304 may include a corresponding tapered face such that the interface with the lower sidewall 336 may bias the at least one key 304 in the radially outward direction, which may prevent the at least one key 304 from retracting. Moreover, in another example, the upper sidewall 334 may be offset from orthogonal by an upper offset angle between negative one and negative fifteen degrees. Further least one at least one key may include another corresponding tapered face such that the interface with the upper sidewall 334 may bias the at least one key 304 in the radially inward direction, which may retract the at least one key 304 as the orienting sub 300 is pulled uphole. Additionally, the channel may include other features (e.g., shoulders, grooves, etc.), which may be configured to interface with corresponding complementary features of the at least one key 304.

Moreover, as illustrated, the upper axial portion 318 may be circumferentially offset from the lower axial portion 320 of the main guide feature 310. Indeed, the at least one helical portion 322 of the main guide feature 310 may extend between the upper axial portion 318 and the lower axial portion 320. As such, the circumferential offset between the upper axial portion 318 and the lower axial portion 320 may be based at least in part on the length and the helix angle 324 of the at least one helical portion 322. As illustrated, the upper axial portion 318 of the main guide feature 310 may be circumferentially offset from the lower axial portion 320 of the main guide feature 310 by an offset angle 342 of one-hundred and twenty degrees. However, the upper axial portion 318 may be circumferentially offset from the lower axial portion 320 by any suitable offset angle 342. For example, the upper axial portion 318 may be circumferentially offset from the lower axial portion 320 by an offset angle 342 between one-hundred degrees and one-hundred and forty degrees. Alternatively, the upper axial portion 318 may be circumferentially offset from the lower axial portion 320 by an offset angle 342 between thirty degrees and one-hundred and eighty degrees.

Moreover, the orienting sub 300 may include at least one control line 344 mounted to the body portion 302 of the orienting sub 300. As illustrated, the control line 344 may be mounted to an exterior surface 346 of the body portion 302 via one or more brackets 348 secured to the body portion 302 along a length of the body portion 302. The control line 344 may extend from the surface to a downhole end of the orienting sub 300. As set forth above, the control line 344 may be configured to connect with a corresponding control line disposed on or proximate to the slotted sub apparatus 202 to establish communication along the control line 344 between the surface and a downhole tool. Further, an outer diameter of the orienting sub 300 may be smaller than the inner diameter of the slotted sub 202 such that there is a sufficiently sized gap between the exterior surface 346 of the orienting sub and the inner surface 326 of the slotted sub for the control lines 344 and/or brackets 348 to pass through the central bore 314, via the gap, as the orienting sub 300 moves through the central bore 314 of the slotted sub 202.

Figure 4:
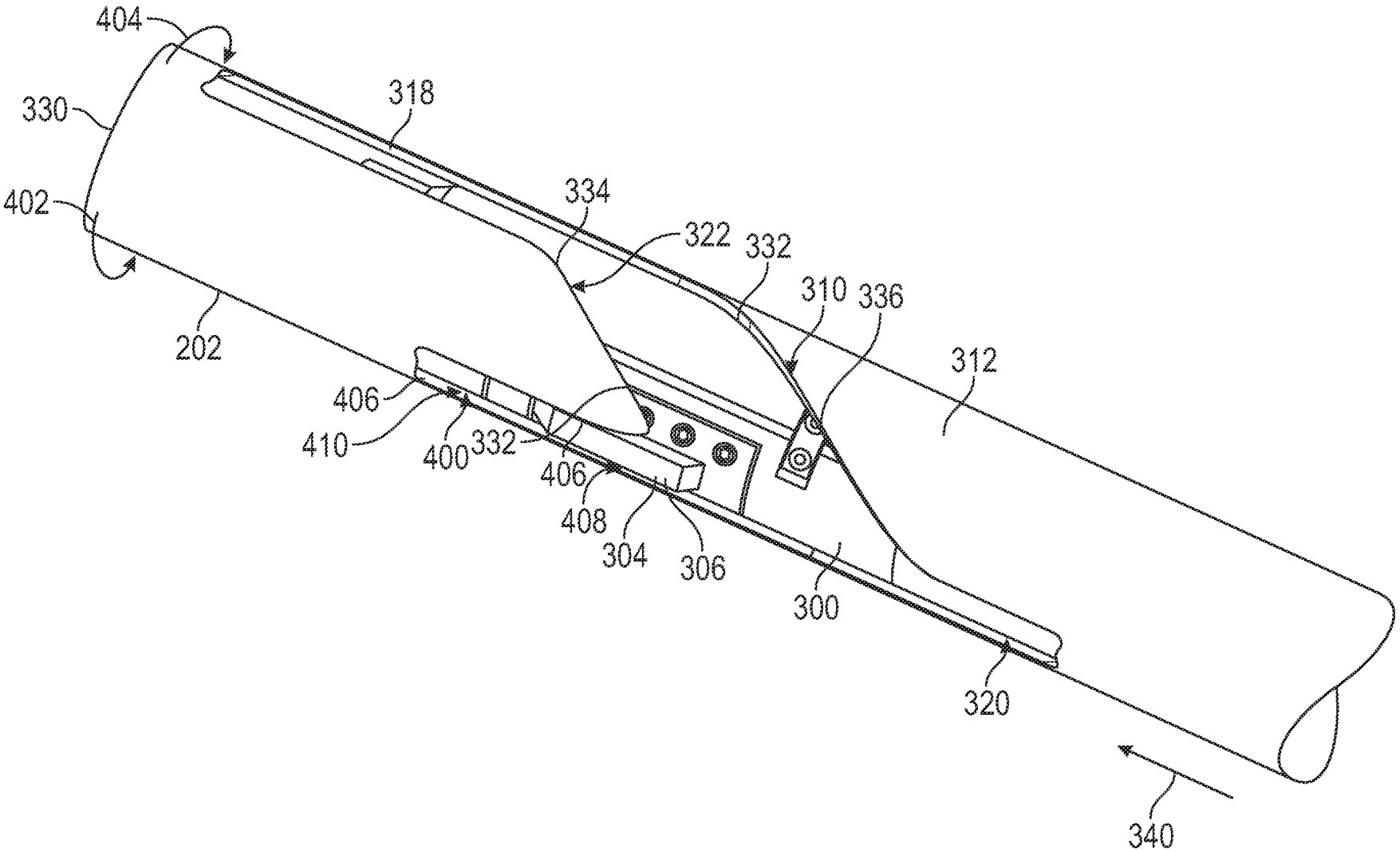
FIG. 4 illustrates a perspective view of a slotted sub apparatus having at least one pullout guide feature, in accordance with some embodiments of the present disclosure.

FIG. 4 illustrates a perspective view of the slotted sub apparatus having at least one pullout guide feature, in accordance with some embodiments of the present disclosure. As illustrated, the at least one pullout guide feature 400 may be connected to the main guide feature 310. As set forth above, the main guide feature 310 of the slotted sub 202 includes the upper axial portion 318, the lower axial portion 320, and the at least one helical portion 322 extending between the upper axial portion 318 and the lower axial portion 320. Further, the main guide feature 310 is configured to guide movement (e.g., rotation) of the orienting sub 300 as the orienting sub 300 moves axially with respect to the tubular body portion 312. Indeed, as the orienting sub 300 moves axially downhole through the slotted sub 202, the main guide feature 310 is configured to rotate the orienting sub 300 via the interface between the main guide feature 310 and the at least one key 304 of the orienting sub 300. Such rotation (e.g., counterclockwise rotation 402) may re-position the orienting sub 300 for connecting the control line 344 to a corresponding control line connector (not shown). However, the main guide feature 310 may rotate the orienting sub 300 in an opposite direction (e.g., clockwise rotation 404) in response to pulling the orienting sub 300 axially uphole back through the slotted sub 202. Such rotation in the opposite direction may tangle the control line 344 secured to the orienting sub 300.

As set forth above, the slotted sub 202 may further include at least one pullout guide feature 400, which may receive the at least one key 304 of the orienting sub 300 as the orienting sub 300 moves in the axially uphole direction 340 with respect to the tubular body portion 312. The at least one pullout guide feature 400 may be configured to guide rotation of the orienting sub 300 as the at least one key 304 moves along the at least one pullout guide feature 400. In particular, the at least one pullout guide feature 400 may be configured reduce rotation of the orienting sub 300 as the orienting sub 300 moves in the axially uphole direction 340 through the slotted sub 202. For example, the at least one pullout guide feature 400 may extend straight in an axial direction along the tubular body portion 312 from the at least one helical portion 322 of the main guide feature 310 toward the upper end 330 of the tubular body portion 312. Alternatively, the at least one pullout guide feature 400 may extend along the tubular body portion 312 from any suitable portion of the main guide feature 310 toward the upper end 330 of the tubular body portion 312. The at least one pullout guide feature 400 may comprise any suitable channel (e.g., a slot, a groove, or some combination thereof) formed in the tubular body portion 312 for guiding the at least one key 304 of the tubular body portion 312. As such, contact between corresponding sidewalls 406 of the at least one pullout guide feature 400 and the at least one key 304 may restrain rotation of the orienting sub 300 as the orienting moves axially uphole with the at least one key 304 in the at least one pullout guide feature 400.

As set forth above, the at least one pullout guide feature 400 may be connected to the main guide feature 310. Specifically, a lower end 408 of the at least one pullout guide feature 400 may extend through the upper sidewall 334 of the helical portion 322 of the main guide feature 310. As such, the at least one key 304 may pass directly from the helical portion 322 to the at least one pullout guide feature 400 as the orienting sub 300 moves in the axially uphole direction 340. Further, as illustrated, the lower end 408 of the at least one pullout guide feature 400 may be circumferentially aligned with the lower axial portion 320 of the main guide feature 310 such that the at least one key 304 may pass directly into the at least one pullout guide feature 400 from the helical portion 322 without the helical portion 322 rotating the orienting sub 300 in the opposite direction (e.g., clockwise rotation 404). As set forth in greater detail below, the lower end 408 of the at least one pullout guide feature 400 may alternatively be circumferentially offset from the lower axial portion 320 such that the at least one key 304 may move along at least some portion of the helical portion 322 before entering into the at least one pullout guide feature 400.

Moreover, the slotted sub 202 may include a plurality of pullout guide features 400. For example, the slotted sub 202 may include a first pullout guide feature 410 and a second pullout guide feature (not shown) circumferentially offset from the first pullout guide feature 410. As set forth above, the orienting sub 300 may include a plurality of keys 304 (e.g., the first key 306, the second key 308, a third key, etc.). During pullout of the orienting sub 300, the first key 306 may move directly from the lower axial portion 320 to the first pullout guide feature 410. As such, the orienting sub 300 may not rotate and the second key 308 may be angularly offset from the main guide feature 310, and as the second key 308 is offset from the main guide feature 310, the second key 308 may not engage the helical portion 322 to rotate the orienting sub 300. However, the third key (not shown) may enter the main guide feature 310 at a position that is angularly offset from the lower axial portion 320. For example, the third key may enter the helical portion 322 directly from the lower sidewall 336 at a position that is forty-five degrees offset from the lower axial portion 320. As such, the second pullout guide feature may be angularly offset from the first pullout guide feature 410 by forty-five degrees such that the third key exits the helical portion 322, via the second pullout guide feature, instead of engaging the upper sidewall 334 of the helical portion 322 to rotate the orienting sub 300. The second pullout guide feature may be angularly offset from the first pullout guide feature 410 by any suitable angle.

Figure 5A:
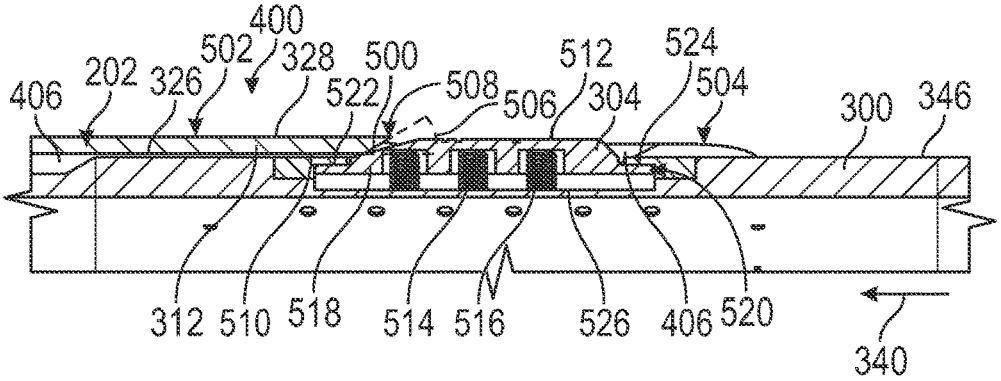
FIGS. 5A-D illustrate respective cross-sectional views and a perspective view of a key of the orienting sub interfacing with a pullout guide feature, in accordance with some embodiments of the present disclosure.

FIGS. 5A-D illustrate respective cross-sectional views and a perspective view of the at least one key of the orienting sub interfacing with the at least one pullout guide feature, in accordance with some embodiments of the present disclosure. In particular, FIG. 5A illustrates the orienting sub 300 moving in the axially uphole direction 340 with the at least one key 304 disposed in an extended position proximate a tapered transition surface 500 of the at least one pullout guide feature 400. As illustrated, an upper section 502 of the pullout guide feature 400 may include a groove formed in the inner surface 326 of the tubular body portion 312 of the slotted sub 202, and a lower section 504 of the pullout guide feature 400 may include a slot extending radially through the tubular body portion 312. The tapered transition surface 500 may be formed between the slot and the groove. That is, the tapered transition surface 500 may include a surface of the tubular body portion 312 that extends at a taper angle 506 from the outer surface 328 of the tubular body portion 312 adjacent the upper end 508 of the slot toward an inner surface 510 of the groove. The tapered transition surface 500 may extend at any suitable taper angle 506 between the slot and the groove. Moreover, as set forth in greater detail below, contact between the at least one key 304 and the tapered transition surface 500 may drive the at least one key 304 from the extended position to a collapsed position as the orienting sub 300 moves in the axially uphole direction 340 along the pullout guide feature 400.

The at least one key 304 may be configured to move between the extended position and a collapsed position. As illustrated, in the extended position, a radially outer surface 512 of the at least one key 304 is disposed radially outward from the orienting sub 300 such that the at least one key 304 may interface with the corresponding sidewalls of the main guide feature 310 and/or sidewalls 406 of the pullout guide feature 400. The orienting sub 300 may include a biasing mechanism 514 configured to bias the at least one key 304 toward the extended position. For example, the biasing mechanism 514 may include a spring assembly 516 (e.g., a plurality of compression springs) configured to bias the at least one key 304. However, any suitable type of biasing mechanism 514 may be used to bias the at least one key 304 toward the extended position.

As illustrated, a base portion 518 of the at least one key 304 may be disposed within a retention cavity 520 formed in the exterior surface 346 of the orienting sub 300. Respective radially outer surfaces 522 of the base portion 518 may interface with respective lip features 524 of the retention cavity 520 to retain the at least one key 304 within the retention cavity 520 in the extended position. The biasing mechanism 514 (e.g., mechanical springs) may be disposed between an inner surface 526 of the retention cavity 520 and the at least one key 304 to bias the at least one key 304 away from an inner surface 526 of the retention cavity 520, but the lip features 524 prevent the at least one key 304 from being ejected from the retention cavity 520 in the extended position. Further, the at least one key 304 may include spring recesses 528 for housing at least a portion of the spring assembly 516. Alternatively, the spring assembly 516 may be entirely positioned between the base portion 518 of the at least one key 304 and the inner surface of the retention cavity 520.

Figure 5B:
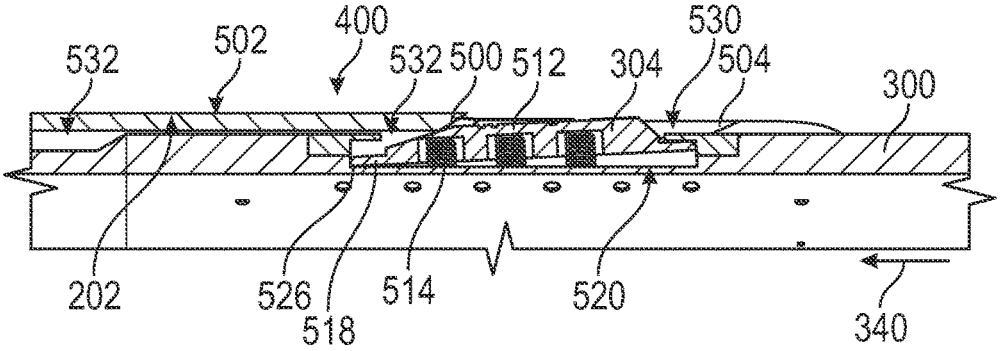

FIG. 5B illustrates the orienting sub 300 moving in the axially uphole direction 340 with the at least one key 304 being driven from the extended position toward the collapsed position in response to contact between the at least one key 304 and the tapered transition surface 500 of the at least one pullout guide feature 400. As set forth above, the lower section 504 of the at least one pullout guide feature 400 includes a pullout slot 530, the upper section 502 of the at least one pullout guide feature 400 includes a pullout groove 532, and the tapered transition surface 500 is formed between the lower section 504 and the upper section 502. Further, contact between the at least one key 304 and the tapered transition surface 500 is configured to drive the at least one key 304 toward the collapsed position as the at least one key 304 moves from the pullout slot 530 of the lower section 504 toward pullout groove 532 of the upper section 502.

For example, contact between the at least one key 304 and the tapered transition surface 500 may be configured to compress the biasing mechanism 514 (e.g., mechanical springs) such that the base portion 518 of the at least one key 304 may move radially inward toward the inner surface 526 of the retention cavity 520. With the base portion 518 of the at least one key 304 disposed proximate the inner surface 526 of the retention cavity 520, the radially outer surface 512 of the at least one key 304 may move radially inward sufficiently such that the at least one key 304 may pass through the pullout groove 532 as the orienting sub 300 moves axially uphole with respect to the slotted sub 202.

Figure 5C:
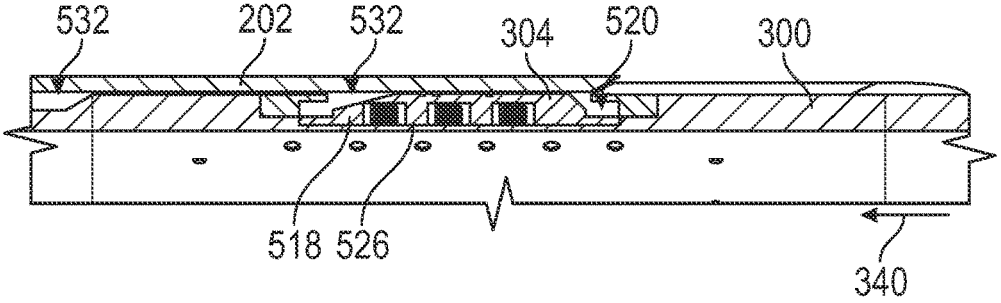

FIG. 5C illustrates the orienting sub 300 moving in the axially uphole direction 340 with the at least one key 304 disposed in the collapsed position. In the collapsed position, the base portion 518 of the at least one key 304 may be disposed against the inner surface 526 of the retention cavity 520. However, the base portion 518 of the at least one key 304 may be slightly offset from the inner surface 526 in the collapsed position. Moreover, with the at least one key 304 in the collapsed position, the at least one key 304 may pass through the pullout groove 532 as the orienting sub 300 moves axially uphole with respect to the slotted sub 202.

Figure 5D:
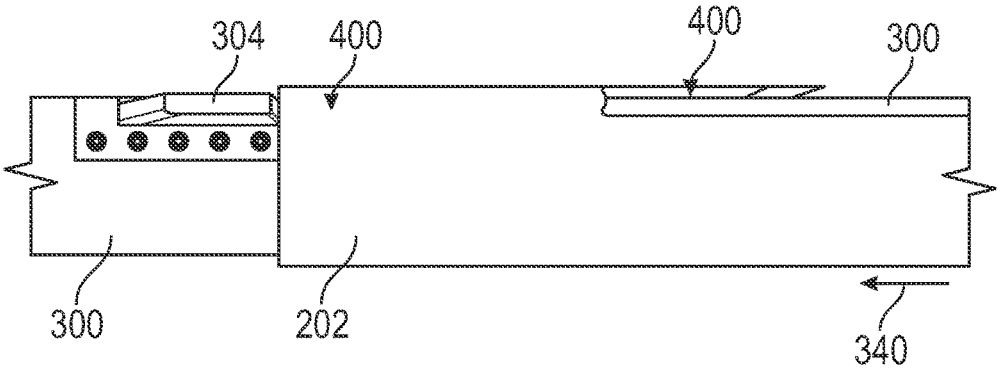

FIG. 5D illustrates the orienting sub 300 moving in the axially uphole direction 340 with the at least one key 304 disposed uphole from the at least one pullout guide feature 400. As the at least one key 304 exits the pullout guide feature 400, the pullout groove (shown in FIG. 5C) is no longer be in contact with the at least one key 304 such that the biasing mechanism 514 (shown in FIG. 5C) may bias the at least one key 304 toward the extended position. As illustrated, the at least one key 304 is in the extended position and disposed axially uphole from the slotted sub 202.

Figure 6:
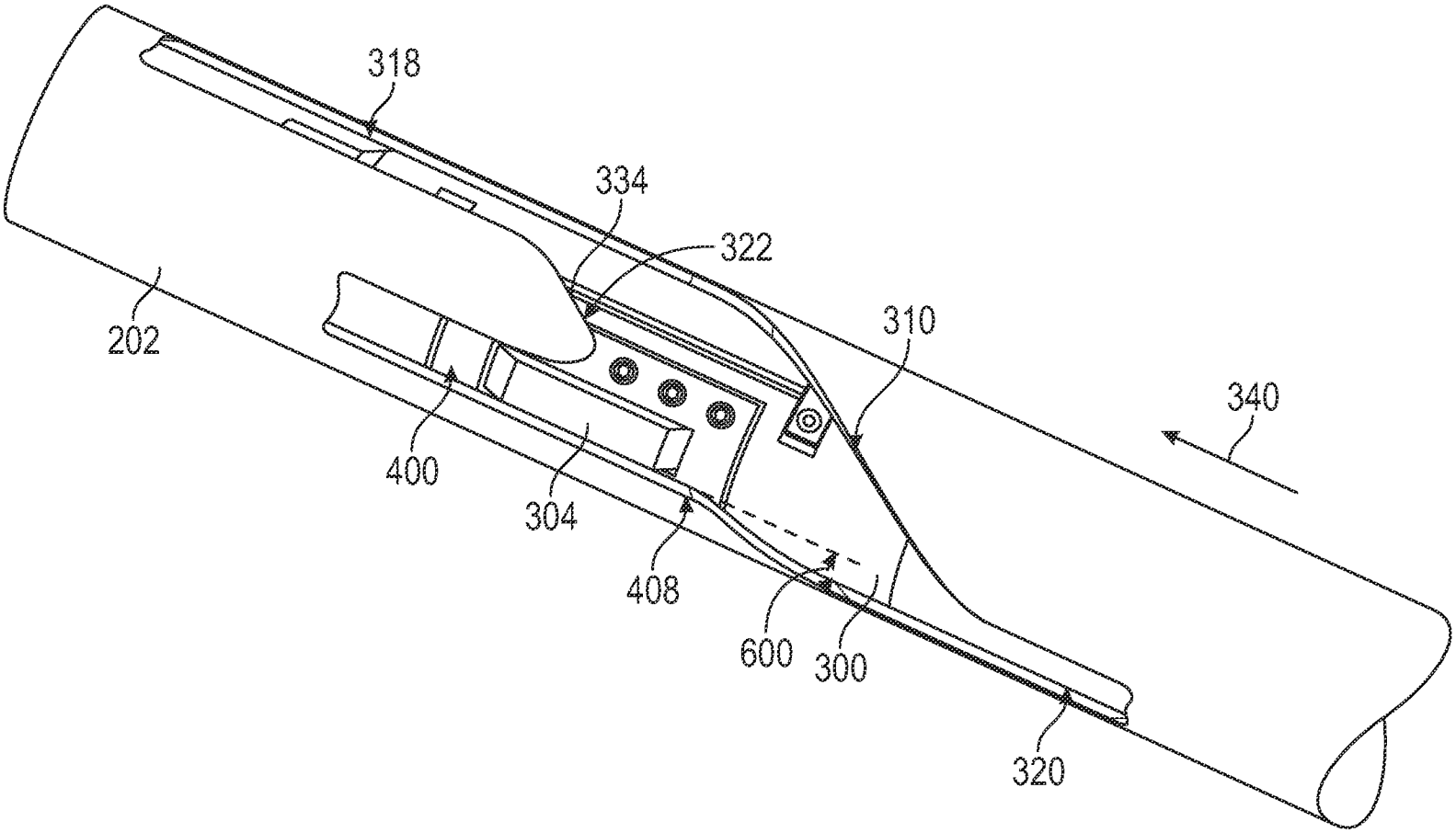
FIG. 6 illustrates a perspective view of a slotted sub apparatus having at least one pullout guide feature circumferentially offset from a lower axial portion of a main guide feature of the slotted sub apparatus, in accordance with some embodiments of the present disclosure.

FIG. 6 illustrates a perspective view of the slotted sub apparatus having the at least one pullout guide feature circumferentially offset from a lower axial portion of a main guide feature of the slotted sub apparatus, in accordance with some embodiments of the present disclosure. As set forth above, the main guide feature 310 comprises the upper axial portion 318, the lower axial portion 320 that is circumferentially offset from the upper axial portion 318, and the helical portion 322 extending between the upper axial portion 318 and the lower axial portion 320. Further, the slotted sub 202 includes the at least one pullout guide feature 400 connected to the main guide feature 310. In particular, the lower end 408 of the at least one pullout guide feature 400 may extend through the upper sidewall 334 of the helical portion 322 such that the at least one key 304 may pass directly from the helical portion 322 to the at least one pullout guide feature 400 as the orienting sub 300 moves in the axially uphole direction 340.

Moreover, the lower end 408 of the at least one pullout guide feature 400 may be positioned circumferentially between the upper axial portion 318 and the lower axial portion 320 of the main guide feature 310. That is, the lower end 408 of the at least one pullout guide feature 400 may be circumferentially offset from the lower axial portion 320 such that, as the orienting sub 300 moves in the axially uphole direction 340, the at least one key 304 may move along at least some portion of the helical portion 322 before entering into the at least one pullout guide feature 400. As illustrated, the lower end 408 of the pullout guide feature 400 may be circumferentially offset from the lower axial portion 320 by thirty degrees. However, the lower end 408 of the pullout guide feature 400 may be circumferentially offset from the lower axial portion 320 by any suitable amount such that the lower end 408 of the pullout guide feature 400 is disposed between the lower axial portion 320 and the upper axial portion 318. For example, the lower end 408 of the pullout guide feature 400 may be circumferentially offset from the lower axial portion 320 by an angle 600 between five degrees and one-hundred and fifteen degrees.

Figure 7:
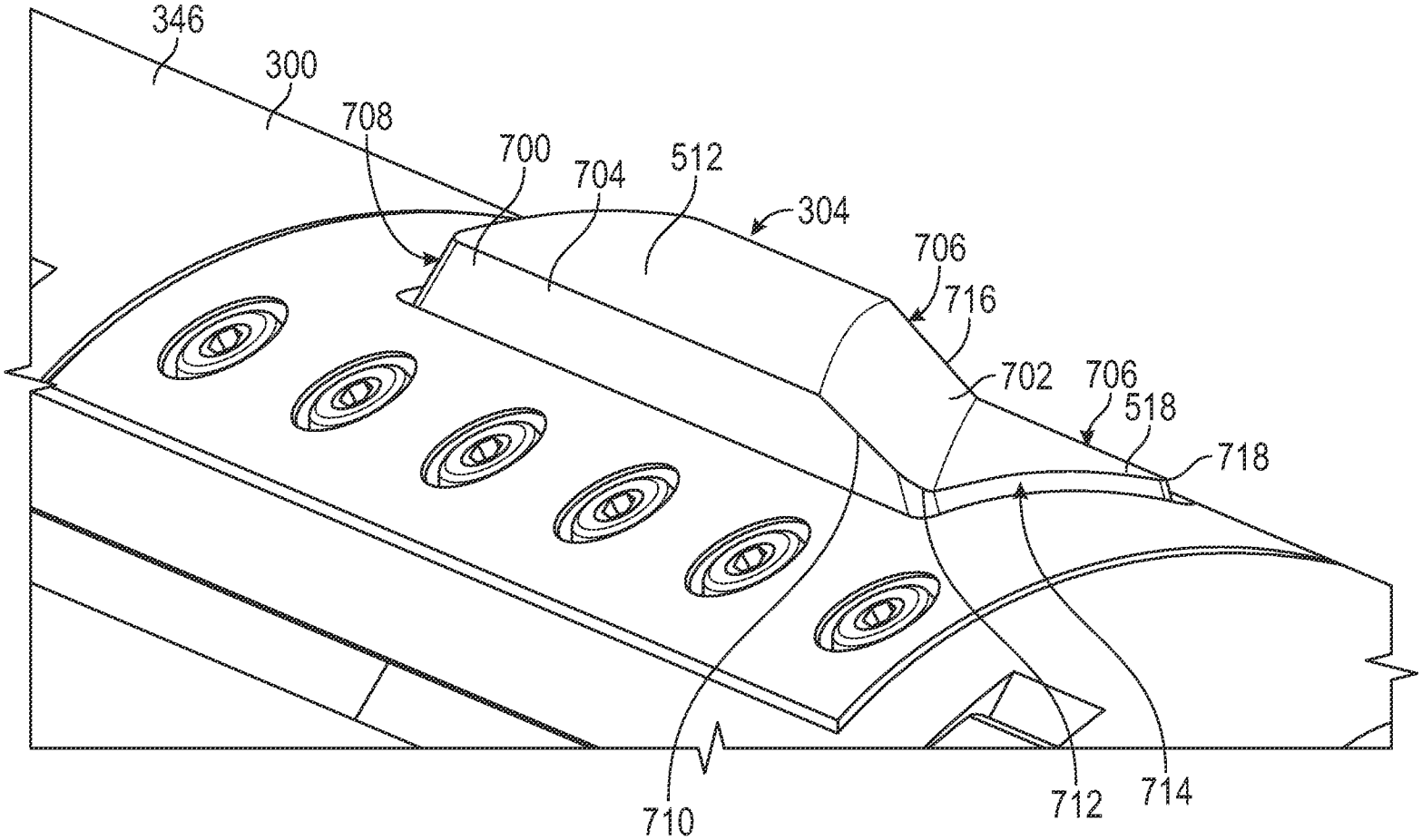
FIG. 7 illustrates a perspective view of a key of an orienting sub having a tapered face, in accordance with some embodiments of the present disclosure.

FIG. 7 illustrates a perspective view of the at least one key of the orienting sub having a tapered face, in accordance with some embodiments of the present disclosure. As set forth above, the at least one key 304 may be configured to move between the extended position and the collapsed position. As illustrated, in the extended position, a radially outer surface 512 of the at least one key 304 is disposed radially outward from the orienting sub 300. Further, various side surfaces 700 (e.g., the tapered face 702, a first sidewall 704, a second sidewall 706, and a lower end face 708) of the at least one key 304 may be disposed radially outward from the exterior surface 346 of the orienting sub 300 such that the various side surfaces 700 may interface with corresponding surfaces (e.g., the upper sidewall 334, the lower sidewall 336, etc.) of the main guide feature 310 and/or the pullout guide feature 400 (shown in FIGS. 3-6). For example, the first sidewall 704 and/or the second sidewall 706 of the at least one key 304 may be configured to interface with the upper sidewall 334 and the lower sidewall 336 of the main guide feature 310 as the at least one key 304 moves through the upper axial portion 318. Further, the lower end face 708 of the at least one key 304 may be configured to interface with the lower sidewall 336 of the main guide feature 310 as the at least one key 304 moves through the helical portion 322 in response to axial downhole movement of the orienting sub 300 through the slotted sub 202 (shown in FIG. 3).

Figure 8B:
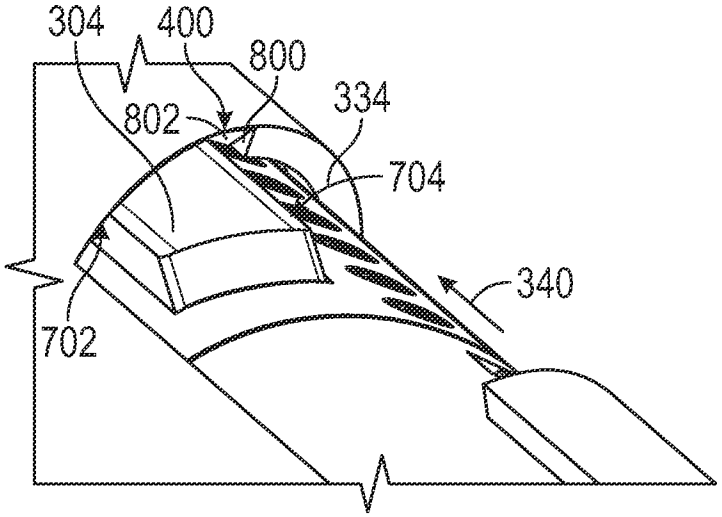
FIGS. 8A-C illustrate respective perspective views a key of an orienting sub interfacing with a pullout guide feature having shoulder feature, in accordance with some embodiments of the present disclosure.

Additionally, the tapered face 702 (e.g., upper end face) of the at least one key 304 may be configured to interface with the upper sidewall 334 of the main guide feature 310 as the at least one key 304 moves through the helical portion 322 in response to axial uphole movement of the orienting sub 300 through the slotted sub 202 (shown in FIG. 8B). However, as set forth in greater detail below, the tapered face 702 may be configured to interface with a corresponding tapered surface of the at least one pullout guide feature 400 to drive the key 304 from the extended position towards the collapsed position such that the at least one key 304 may exit the helical portion 322 of the main guide feature 310 and continue to move in the axially uphole direction 340.

The tapered face 702 may extend at any suitable angle from the base portion 518 of the at least one key 304 to the radially outer surface 512 of the at least one key 304. As illustrated, the tapered face 702 may extend from the base portion 518 to the radially outer surface 512 by an angle between thirty degrees and sixty degrees. Alternatively, the tapered face 702 may extend from the base portion 518 to the radially outer surface 512 by an angle between ten degrees and eighty degrees. Moreover, a first edge 710 of the tapered face 702 may extend from a first upper corner 712, formed between an upper end 714 of the base portion 518 and the first sidewall 704, to the radially outer surface 512. However, a second edge 716 may extend from a position axially offset from a second upper corner 718, which is formed between the upper end 714 of the base portion 518 and the second sidewall 706 of the at least one key 304 such that the tapered face 702 may be angularly offset from the upper end 714 of the at least one key 304.

Figure 8A:
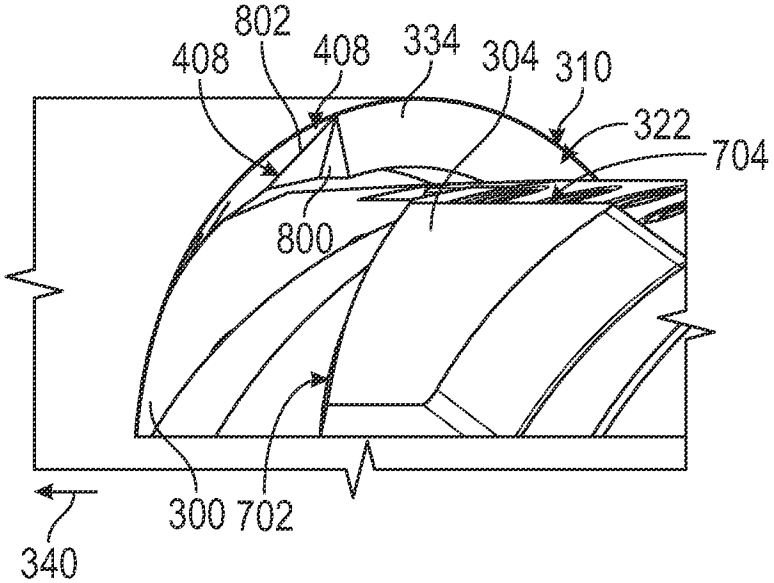
Figure 8C:
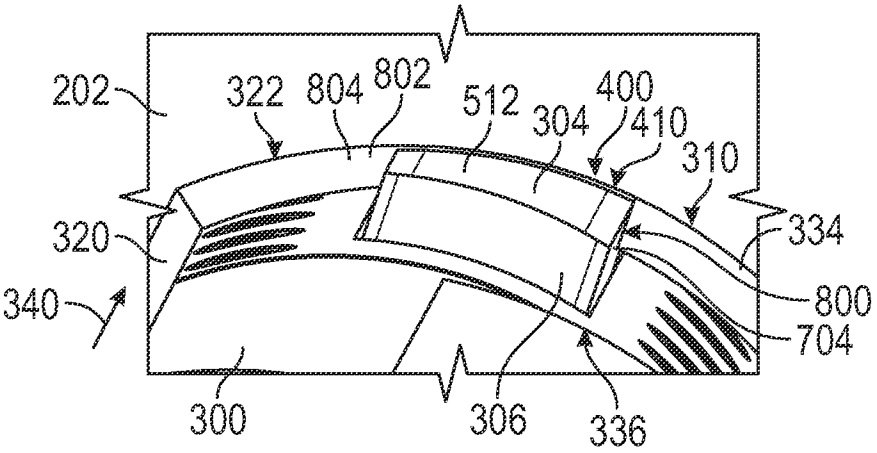

FIGS. 8A-C illustrate respective perspective views of the at least one key of the orienting sub interfacing with the pullout guide feature having shoulder feature, in accordance with some embodiments of the present disclosure. In particular, FIG. 8A illustrates the at least one key 304 of the orienting sub 300 moving in the axially uphole direction 340 toward the at least one pullout guide feature 400. In particular, the at least one key 304 is moving through the helical portion 322 of the main guide feature 310 in the uphole direction 340 toward the upper sidewall 334. As set forth above, the lower end 408 of the at least one pullout guide feature 400 may extend through the upper sidewall 334 of the helical portion 322 such that the at least one key 304 may pass directly from the helical portion 322 to the at least one pullout guide feature 400 as the orienting sub 300 moves in the axially uphole direction 340. Alternatively, or additionally, the at least one pullout guide feature 400 may include a shoulder feature 800 formed in the upper sidewall 334 of the helical portion 322. As set forth in greater detail below, the shoulder feature 800 is configured to interface with the first sidewall 704 of the at least one key 304 to restrain movement of the at least one key 304 along the upper sidewall 334 of the main guide feature 310 in response to the orienting sub 300 moving in the axially uphole direction 340.

Further, the at least one pullout guide feature 400 may include a tapered surface 802 configured to interface with the at least one key 304 to drive the key 304 from the extended position towards the collapsed position. In particular, as the first sidewall 704 of the key 304 interfaces with the shoulder feature 800, continued axially uphole movement of the orienting sub 300 may drive the tapered face 702 of the at least one key 304 axially into the tapered surface 802 of the pullout guide feature 400, which may drive the at least one key 304 toward the collapsed position as the at least one key 304 moves in the axially uphole direction 340. With the at least one key 304 compressed, the at least one key 304 may exit the helical portion 322 of the main guide feature 310 and continue to move in the axially uphole direction 340 such that the orienting sub 300 may continue in the axially uphole direction 340 without rotating. As illustrated, the pullout guide feature 400 may include the shoulder feature 800 and the tapered surface 802. However, the pullout guide feature 400 may additionally include a channel (e.g., slot or groove) configured to receive the at least one key 304 as the at least one key 304 exits the helical portion 322 to restrain rotation of the orienting sub 300 as the orienting sub 300 moves in the axially uphole direction 340.

FIG. 8B illustrates the tapered face 702 of the at least one key 304 moving along the tapered surface 802 of the pullout guide feature 400. As set forth above, the tapered surface 802 of the pullout guide feature 400 may be formed in the upper sidewall 334 of the main guide feature 310. Moreover, as set forth above, the tapered face 702 may be angularly offset from the upper end 714 of the at least one key 304 by any suitable angle (shown in FIG. 7) such that a majority of the tapered face 702 of the at least one key 304 may interface with the tapered surface 802 as the at least one key 304 moves along the tapered surface 802 toward the shoulder feature 800.

The tapered surface 802 may include a sufficiently steep angle such a radial force component from the interface between the tapered face 702 and the tapered surface 802 is not sufficient to compress the at least one key 304 in the radially inward direction until the first sidewall 704 of the at least one key 304 engages the shoulder feature 800. That is, engaging the shoulder feature 800 may increase the axial force applied to the interface between the tapered face 702 and the tapered surface 802, as the orienting sub 300 moves in the axially uphole direction 340, such that the radial force component may increase sufficiently to compress the at least one key 304 in response to engaging the shoulder feature 800. For example, the tapered face 702 may be angularly offset from the axial direction by and angle between sixty degrees and eighty degrees. However, the tapered face 702 may be angularly offset from the axial direction by any suitable angle. Additionally, the angle of the tapered surface 802 may be based at least in part on a compressive strength of the biasing mechanism 514 that is biasing the at least one key 304 toward the extended position (shown in FIG. 5A).

FIG. 8C illustrates the at least one key 304 engaging the shoulder feature 800 of the at least one pullout guide feature 400 as the orienting sub 300 moves in the axially uphole direction 340. In particular, the first sidewall 704 of the at least one key 304 engages the shoulder feature 800. As set forth above, the interface between the first sidewall 704 and the shoulder feature 800 restrains movement of the at least one key 304 along the upper sidewall 334 of the main guide feature 310 as the orienting sub 300 moves in the axially uphole direction 340. Further, as the first sidewall 704 of the key 304 interfaces with the shoulder feature 800, continued axially uphole movement of the orienting sub 300 may drive the tapered face 702 (shown in FIGS. 7 and 8A) of the at least one key 304 axially into the tapered surface 802 of the pullout guide feature 400, which may drive the at least one key 304 toward the collapsed position as the at least one key 304 moves in the axially uphole direction 340. With the at least one key 304 compressed, the at least one key 304 may exit the helical portion 322 of the main guide feature 310 and continue to move in the axially uphole direction 340 such that the orienting sub 300 may continue in the axially uphole direction 340 without rotating.

Moreover, the orienting sub 300 may include a plurality of keys 304. For example, the orienting sub 300 may include a first key 306 and a second key (shown in FIG. 3). However, the orienting sub 300 may include any suitable number of keys. Further, the first key 306 may have a first shape and the second key 308 may have a second shape that is different from the first shape. For example, a first tapered face of the first key 306 may extend from a base portion 518 of the first key 306 toward a radially outer surface 512 of the first key 306 by a first angle, and a second tapered face of the second key 308 may extend from a base portion of the second key toward a radially outer surface of the second key by a second angle. The first angle may be different than the second angle. For example, the first angle may be thirty degrees and the second angle may be forty-five degrees.

Further, the slotted sub 202 may include a plurality of pullout guide features 400. For example, the slotted sub 202 may include a first pullout guide feature 410 having a first shoulder feature configured to interface with the first key 306 to redirect the first key 306 from the helical portion 322 of the main guide feature 310 and into the axially uphole direction 340 and/or into a lower end of the first pullout guide feature 410. Additionally, the slotted sub 202 may include a second pullout guide feature (not shown) having a second shoulder feature configured to interface with the second key to redirect the second key from the helical portion 322 of the main guide feature 310 and into the axially uphole direction 340 and/or into a lower end of the second pullout guide feature.

The first pullout guide feature 410 may be circumferentially offset from the second pullout guide feature. For example, the shoulder feature 800 of the first pullout guide feature 410 may be angularly offset from the lower axial portion 320 by thirty degrees and the second shoulder of the second pullout guide feature may be angularly offset from the lower axial portion 320 by ninety degrees. As such, the orienting sub 300 may rotate about thirty degrees as the first key 306 moves along the helical portion 322 of the main guide feature 310 and engages the shoulder feature 800. The first key 306 may compress and exit the helical portion 322 in response to engaging the shoulder feature 800 such that the orienting sub 300 may continue to move in the axial direction without rotation.

Further, the second key 308, or an additional key (e.g., a third key, a fourth key, etc.), may enter the helical portion 322 of the main guide feature 310 after continued axial movement of the orienting sub 300. The second key 308 may not enter the helical portion 322 from the lower axial portion 320. Instead, the second key 308 may enter the helical portion 322 from the lower sidewall 336 of the helical portion 322 at a position that is axially offset from the lower axial portion 320. For example, the second key 308 may enter the helical portion 322 at a position that is angularly offset from the lower axial portion 320 by about forty-five degrees. As such, the second key 308 may engage the upper sidewall 334 (e.g., a second tapered surface) of the helical portion 322 between the shoulder feature 800 and the second shoulder (not shown). The second key may move along the upper sidewall 334 in a direction toward the second shoulder. At the second shoulder, the second key 308 may compress and exit the helical portion 322 in response to engaging the second shoulder such that the orienting sub 300 may continue to move in the axial direction without rotation.

Alternatively, the second key 308 may enter the helical portion 322 in a position between the lower axial portion 320 and the shoulder feature 800. However, the upper sidewall 334 of the helical portion 322 may include a first tapered surface 804 having a first angle and extending between the lower axial portion 320 and the shoulder feature 800 and a second tapered surface having a second angle and extending between the shoulder feature 800 and the second shoulder feature. The first key 306 may be configured to engage the first tapered surface 802 and the shoulder feature 800. Further, the second key 308 may have an angle corresponding to the second tapered surface such that the second key 308 continues to move along the first tapered surface 802 and continues to move past the shoulder feature 800 to engage the second tapered surface and the second shoulder feature. As set forth above, at the second shoulder feature, the second key 308 may compress and exit the helical portion 322 in response to engaging the second shoulder feature such that the orienting sub 300 may continue to move in the axial direction without rotation.

Accordingly, the present disclosure may provide a slotted sub apparatus having a pullout guide feature to control rotation of an orienting sub during pullout. The methods and systems may include any of the various features disclosed herein, including one or more of the following statements.

Statement 1. A slotted sub apparatus, comprising: a tubular body portion; a main guide feature extending axially along the tubular body portion, wherein the main guide feature is configured to receive a key of an orienting sub, and wherein an interface between the key and sidewalls of the main guide feature is configured to guide rotation of the orienting sub as the orienting sub moves axially with respect to the tubular body portion; and at least one pullout guide feature configured to receive the key of the orienting sub as the orienting sub moves in an axially uphole direction with respect to the tubular body portion, wherein the at least one pullout feature is configured to guide rotation of the orienting sub as the key moves along the at least one pullout guide feature.

Statement 2. The slotted sub apparatus of statement 1, wherein the at least one pullout guide feature comprises a slot, a groove, or some combination thereof, formed in the tubular body portion.

Statement 3. The slotted sub apparatus of statement 1, wherein the at least one pullout guide feature is straight and extends in an axial direction along the tubular body portion from a portion of the main guide feature toward an upper end of the tubular body portion.

Statement 4. The slotted sub apparatus of statement 1, wherein the main guide feature comprises an upper axial portion, a lower axial portion that is circumferentially offset from the upper axial portion, and a helical portion extending between the upper axial portion to the lower axial portion.

Statement 5. The slotted sub apparatus of statement 4, wherein a lower end of the at least one pullout guide feature extends through an upper sidewall of the helical portion of the main guide feature.

Statement 6. The slotted sub apparatus of statement 4, wherein a lower end of the at least one pullout guide feature is circumferentially aligned with a lower axial portion of the main guide feature.

Statement 7. The slotted sub apparatus of statement 4, wherein the at least one pullout guide feature is positioned circumferentially between upper axial portion and the lower axial portion of the main guide feature.

Statement 8. The slotted sub apparatus of statement 4, wherein the upper axial portion of the main guide feature is circumferentially offset from the lower axial portion of the main guide feature by an angle between thirty to one-hundred and eighty degrees.

Statement 9. The slotted sub apparatus of statement 1, wherein a lower end of the at least one pullout guide feature comprises a shoulder feature configured to interface with the key of the orienting sub to redirect the key from the main guide feature and into the lower end of the at least one pullout guide.

Statement 10. A system, comprising: an orienting sub securable to a downhole end of a conveyance and configured to be run into a wellbore via the conveyance, the orienting sub including: a body portion; and at least one key extending radially outward from the body portion; and a slotted sub apparatus configured to receive the orienting sub, the slotted sub apparatus including: a tubular body portion; a main guide feature extending axially along the tubular body portion, wherein the main guide feature is configured to receive the at least one key, and wherein an interface between the at least one key and sidewalls of the main guide feature is configured to guide rotation of the orienting sub as the sub moves axially with respect to the tubular body portion; and at least one pullout guide feature configured to receive the at least one key of the orienting sub as the orienting sub moves in an axially uphole direction with respect to the tubular body portion, wherein the at least one pullout feature is configured to guide rotation of the orienting sub as the at least one key moves along the at least one pullout guide feature.

Statement 11. The slotted sub apparatus of statement 10, wherein the at least one key extends radially outward from the orienting sub, and wherein respective sides of the at least one key are configured to interface with the corresponding sidewalls of the main guide feature to guide rotation of the orienting sub as the sub moves axially with respect to the tubular body portion.

Statement 12. The slotted sub apparatus of statement 10, wherein the at least one key is configured to move between an extended position and collapsed position, wherein a radially outer surface of the at least one key is disposed radially outward from the orienting sub in the extending position, and wherein the at least one key is configured to interface with the corresponding sidewalls of the main guide feature in the extended position.

Statement 13. The slotted sub apparatus of statement 11, further comprising a biasing mechanism configured to bias the at least one key toward the extended position, wherein the biasing mechanism comprises a mechanical spring disposed between the at least one key and a housing recess formed in the radially outer surface of the orienting sub.

Statement 14. The slotted sub apparatus of statement 10, wherein the key comprises a tapered face configured to interface with a corresponding tapered surface of the at least one pullout guide feature to drive the key from the extended position towards the collapsed position.

Statement 15. The slotted sub apparatus of statement 10, wherein the main guide feature comprises an upper axial portion, a lower axial portion that is circumferentially offset from the upper axial portion, and a helical portion extending between the upper axial portion to the lower axial portion.

Statement 16. The slotted sub apparatus of statement 10, wherein the main guide feature extends at least partially through the tubular body portion of the slotted sub apparatus in a radial direction from an inner surface of the tubular body portion.

Statement 17. The slotted sub apparatus of statement 10, wherein a lower section of the at least one pullout guide feature comprises a slot and an upper section of the at least one pullout guide feature comprises a groove, and wherein the at least one pullout guide feature comprises a tapered transition surface between the lower section and the upper section, wherein the tapered transition surface is configured to drive the key toward the collapsed position as the key moves from the lower section toward the upper section of the at least one pullout guide feature.

Statement 18. The slotted sub apparatus of statement 10, wherein the at least one key comprises a first key having a first shape and a second key having a second shape that is different from the first shape, and wherein the at least one pullout guide feature comprises a first pullout guide feature having a first shoulder feature configured to interface with the first key to redirect the first key from the main guide feature and into a lower end of the first pullout guide feature, and wherein the at least one pullout guide feature comprises a second pullout guide feature having a second shoulder feature configured to interface with the second key to redirect the second key from the main guide feature and into a lower end of the second pullout guide feature.

Statement 19. The slotted sub apparatus of statement 18, wherein the first pullout guide feature comprises a first slot and/or groove, wherein the second pullout guide feature comprises a second slot and/or groove, and wherein the first pullout guide feature is circumferentially offset from the second pullout guide feature.

Statement 20. A system, comprising: an orienting sub securable to a downhole end of a conveyance and configured to be run into a wellbore via the conveyance, the orienting sub including: a body portion; at least one key extending radially outward from the body portion; and a control line secured to the body portion, wherein the control line is configured to connect to a corresponding connection to provide communication between the surface and a downhole tool; and a slotted sub apparatus configured to receive the orienting sub, the slotted sub apparatus including: a tubular body portion; a main guide feature extending axially along the tubular body portion, wherein the main guide feature is configured to receive the at least one key, and wherein an interface between the at least one key and sidewalls of the main guide feature is configured to guide rotation of the orienting sub as the sub moves axially with respect to the tubular body portion, wherein the rotation of the orienting sub is configured to align the control line with the corresponding connection; and at least one pullout guide feature configured to receive the at least one key of the orienting sub as the orienting sub moves in an axially uphole direction with respect to the tubular body portion, wherein the at least one pullout feature is configured to guide rotation of the orienting sub as the at least one key moves along the at least one pullout guide feature.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A system comprising:

an orienting sub comprising a plurality of keys, wherein a first key of the plurality of keys is circumferentially offset from a second key of the plurality of keys and wherein the first key has a first shape and the second key has a second shape different from the first shape; and a slotted sub apparatus, comprising:

a tubular body portion;

a main guide feature extending axially along the tubular body portion, wherein the main guide feature is configured to receive the first key, wherein the second key is angularly offset from the main guide feature, and wherein an interface between the first key and sidewalls of the main guide feature is configured to rotate the orienting sub as the orienting sub moves axially with respect to the tubular body portion; and at least one pullout guide feature configured to receive the first key as the orienting sub moves in an axially uphole direction with respect to the tubular body portion, wherein the at least one pullout feature is configured to guide the orienting sub as the first key moves along the at least one pullout guide feature.

2. The system of claim 1, wherein the at least one pullout guide feature comprises a slot, a groove, or some combination thereof, formed in the tubular body portion.

3. The system of claim 1, wherein the at least one pullout guide feature is straight and extends in an axial direction along the tubular body portion from a portion of the main guide feature toward an upper end of the tubular body portion.

4. The system of claim 1, wherein the main guide feature comprises an upper axial portion, a lower axial portion that is circumferentially offset from the upper axial portion, and a helical portion extending between the upper axial portion to the lower axial portion.

5. The system of claim 4, wherein a lower end of the at least one pullout guide feature extends through an upper sidewall of the helical portion of the main guide feature.

6. The system of claim 4, wherein a lower end of the at least one pullout guide feature is circumferentially aligned with a lower axial portion of the main guide feature.

7. The system of claim 4, wherein the at least one pullout guide feature is positioned circumferentially between upper axial portion and the lower axial portion of the main guide feature.

8. The system of claim 4, wherein the upper axial portion of the main guide feature is circumferentially offset from the lower axial portion of the main guide feature by an angle between thirty to one-hundred and eighty degrees.

9. The system of claim 1, wherein a lower end of the at least one pullout guide feature comprises a shoulder feature configured to interface with the first key of the orienting sub to redirect the first key from the main guide feature and into the lower end of the at least one pullout guide.

10. A system, comprising:

an orienting sub securable to a downhole end of a conveyance and configured to be run into a wellbore via the conveyance, the orienting sub including:

a body portion; and at least one key extending radially outward from the body portion, wherein the at least one key comprises a first key having a first shape and a second key having a second shape that is different from the first shape; and a slotted sub apparatus configured to receive the orienting sub, the slotted sub apparatus including:

a tubular body portion;

a main guide feature extending axially along the tubular body portion, wherein the main guide feature is configured to receive the at least one key, and wherein an interface between the at least one key and sidewalls of the main guide feature is configured to guide rotation of the orienting sub as the sub moves axially with respect to the tubular body portion; and at least one pullout guide feature configured to receive the at least one key of the orienting sub as the orienting sub moves in an axially uphole direction with respect to the tubular body portion and guide rotation of the orienting sub as the at least one key moves along the at least one pullout guide feature, and wherein the at least one pullout guide feature comprises:

a first pullout guide feature having a first shoulder feature configured to interface with the first key to redirect the first key from the main guide feature and into a lower end of the first pullout guide feature; and a second pullout guide feature having a second shoulder feature configured to interface with the second key to redirect the second key from the main guide feature and into a lower end of the second pullout guide feature.

11. The system of claim 10, wherein the at least one key extends radially outward from the orienting sub, and wherein respective sides of the at least one key are configured to interface with the corresponding sidewalls of the main guide feature to guide rotation of the orienting sub as the sub moves axially with respect to the tubular body portion.

12. The system of claim 10, wherein the at least one key is configured to move between an extended position and collapsed position, wherein a radially outer surface of the at least one key is disposed radially outward from the orienting sub in the extending position, and wherein the at least one key is configured to interface with the corresponding sidewalls of the main guide feature in the extended position.

13. The system of claim 11, further comprising a biasing mechanism configured to bias the at least one key toward the extended position, wherein the biasing mechanism comprises a mechanical spring disposed between the at least one key and a housing recess formed in the radially outer surface of the orienting sub.

14. The system of claim 10, wherein the key comprises a tapered face configured to interface with a corresponding tapered surface of the at least one pullout guide feature to drive the key from the extended position towards the collapsed position.

15. The system of claim 10, wherein the main guide feature comprises an upper axial portion, a lower axial portion that is circumferentially offset from the upper axial portion, and a helical portion extending between the upper axial portion to the lower axial portion.

16. The system of claim 10, wherein the main guide feature extends at least partially through the tubular body portion of the slotted sub apparatus in a radial direction from an inner surface of the tubular body portion.

17. The system of claim 10, wherein a lower section of the at least one pullout guide feature comprises a slot and an upper section of the at least one pullout guide feature comprises a groove, and wherein the at least one pullout guide feature comprises a tapered transition surface between the lower section and the upper section, wherein the tapered transition surface is configured to drive the key toward the collapsed position as the key moves from the lower section toward the upper section of the at least one pullout guide feature.

18. The system of claim 10, wherein the first pullout guide feature comprises a first slot or groove, wherein the second pullout guide feature comprises a second slot or groove, and wherein the first pullout guide feature is circumferentially offset from the second pullout guide feature.

19. A system, comprising:

an orienting sub securable to a downhole end of a conveyance and configured to be run into a wellbore via the conveyance, the orienting sub including:

a body portion;

a plurality of keys extending radially outward from the body portion, wherein each key of the plurality of keys has a different shape; and a control line secured to the body portion, wherein the control line is configured to connect to a corresponding connection to provide communication between the surface and a downhole tool; and a slotted sub apparatus configured to receive the orienting sub, the slotted sub apparatus including:

a tubular body portion;

a main guide feature extending axially along the tubular body portion, wherein the main guide feature comprises an upper axial portion, a lower axial portion that is circumferentially offset from the upper axial portion, and a helical portion extending between the upper axial portion to the lower axial portion, wherein the main guide feature is configured to receive at least one key of the plurality of keys, and wherein an interface between the at least one key and sidewalls of the helical portion of the main guide feature is configured to rotate of the orienting sub and guide the at least one key toward the lower axial portion as the orienting sub moves in the axially downhole direction with respect to the tubular body portion, wherein the rotation of the orienting sub is configured to align the control line with the corresponding connection; and at least one pullout guide feature configured to receive the at least one key of the orienting sub as the orienting sub moves in an axially uphole direction with respect to the tubular body portion, wherein the at least one pullout feature is configured to guide rotation of the orienting sub as the at least one key moves along the at least one pullout guide feature.

* * * * *